United States Patent [19]

Jackson

[11] Patent Number: 4,505,847

[45] Date of Patent: Mar. 19, 1985

[54] ELECTRICALLY-CONDUCTIVE MATERIALS

[75] Inventor: John Jackson, Lanark, Scotland

[73] Assignee: University of Strathclyde, Glasgow, Scotland

[21] Appl. No.: 476,324

[22] Filed: Mar. 17, 1983

[30] Foreign Application Priority Data

Mar. 2, 1982 [GB] United Kingdom ..... 8208229

[51] Int. Cl.[3] ..... H01B 1/06

[52] U.S. Cl. ..... 252/511; 252/502; 252/510

[58] Field of Search ..... 252/511, 510, 502; 524/495, 496

[56] References Cited

U.S. PATENT DOCUMENTS

| | | | |
|---|---|---|---|
| 4,051,454 | 9/1977 | Leiser et al. | 252/511 |
| 4,145,317 | 3/1979 | Sado et al. | 252/511 |
| 4,273,697 | 6/1981 | Funimura | 252/511 |
| 4,382,024 | 5/1983 | Seaman et al. | 252/511 |
| 4,387,046 | 6/1983 | Mausch et al. | 252/511 |
| 4,433,096 | 2/1984 | Bokeman et al. | 524/495 |

*Primary Examiner*—Josephine L. Barr

*Attorney, Agent, or Firm*—Bell, Seltzer, Park & Gibson

[57] ABSTRACT

Electrically-conductive materials comprising silicone rubber in combination with carbon particles in graphitic form incorporate a vegetable oil additive to provide enhanced physical and electrical resistance properties. Electrical resistivity for stress loadings below 500 grammes per square millimeter is less than 500 ohm-meters and for step changes in stress is of the order of 1K ohms-cm. A large number of vegetable oils provide these characteristics in the materials when the vegetable oils are present in the material in the range of 10–30% by volume. Carbon loading may be in the range 50–90% when measured in carbon grammes weight in relation to the milliliter content of the volume of silicone rubber and vegetable oil.

9 Claims, 22 Drawing Figures

| | GRAPHITE % | TENSILE STRESS gf/mm$^2$ | TENSILE STRAIN % | RESISTIVITY Ω-m |
|---|---|---|---|---|
| NO OIL | 50 | 140.79 | 145.5 | 2.216 |
| | 70 | 56.31 | 7.1 | 1.172 |
| | 90 | – | – | – |
| COCONUT | 50 | 74.1 | 173.66 | 1.045 |
| | 70 | 53.82 | 146.05 | 1.004 |
| | 90 | 63.69 | 139.7 | 0.236 |
| OLIVE | 50 | 64.5 | 157 | 7.150 |
| | 70 | 58.7 | 127 | 0.946 |
| | 90 | 29.3 | 77 | 0.142 |
| SILICONE | 50 | 122 | 153 | 220.0 |
| | 70 | 101 | 97 | 11.60 |
| | 90 | – | – | – |
| ARACHIS | 50 | 51.8 | 90 | 7.680 |
| | 70 | 62.4 | 138 | 0.855 |
| | 90 | 42.1 | 117 | 0.276 |
| PALM | 50 | 60 | 120 | 4.035 |
| | 70 | 55 | 140 | 0.987 |
| | 90 | 50 | 145 | 0.256 |

ELECTRO-TENSILE DATA FOR SILCOSET 105 WITH 10% VEGETABLE OIL AND VARIOUS AMOUNTS OF GRAPHITE.

FIG. 16

| FATTY ACIDS (g/100g) | ARACHIS | COCONUT | OLIVE | PALM |
|---|---|---|---|---|
| SATURATED | | | | |
| ARACHIDIC | — | 0.4 | 0.1 | — |
| CAPROIC | — | 0.8 | — | — |
| CAPRYLIC | — | 5.4 | — | — |
| CAPRIC | — | 8.4 | — | — |
| LAURIC | — | 45.4 | — | — |
| MYRISTIC | — | 18.0 | Tr | 1.4 |
| PALMITIC | — | 10.5 | 6.9 | 40.1 |
| STEARIC | — | 2.3 | 2.3 | 5.5 |
| UNSAT | | | | |
| LINOLEIC | M | Tr | 4.6 | 10.3 |
| OLEIC | M | 7.5 | 84.4 | 42.7 |
| PALMIT-OLEIC | — | 0.4 | — | — |

(M Major components & Tr = Trace)

FIG. 17

| Carbon Content (grams/vol) | RESISTIVITY | | Rupture Strain (%) | No. of 180° flexes before failure |
|---|---|---|---|---|
| | Ω-cm | Ω-cm | | |
| 0 | 720M | 720M | 150 | 70 |
| 8.3 | 720M | 720M | 100 ± 25 | 46 |
| 16.7 | 4.3 k | 10k | -II- | 7400 |
| 25 | 1.1k | 2.1k | -II- | 7400 |
| 33.3 | 0.7k | 1.1k | -II- | -II- |
| 66.7 | 0.5k | 1.1k | -II- | -II- |

| STRAIN % | EP 411 (ICI) | | Q3-3321 (Dow Corning) | |
|---|---|---|---|---|
| | RESISTANCE kΩ | $Log_{10}R$ | RESISTANCE kΩ | $Log_{10}R$ |
| 0 | 1.4 | 0.15 | 4.3 | 0.63 |
| 15 | 2.3 | 0.36 | 7.5 | 0.88 |
| 25 | 4.9 | 0.69 | 13.7 | 1.14 |
| 50 | 8.8 | 0.94 | 65.5 | 1.8 |
| 75 | 30.0 | 1.5 | 1300.0 | 3.1 |
| 100 | 80.0 | 1.9 | $720 \times 10^3$ | 4.3 |

ADDITIONS: Arachis oil 20% wt/vol
Graphite powder 66.7% vol/vol } EP 411, Q3-3321
+ respective curing agents.

ELECTRICALLY-CONDUCTIVE MATERIALS

This invention relates to electrically-conductive materials in which electrical resistivity is related to stress loading on the material.

Electrically-conductive materials in which electrical resistivity is related to stress loading on the material are sometimes referred to as 'piezoresistive' and form a known class of materials having a wide variety of uses. Many examples of these known materials, their production and their uses, are described in the book "Conductive Rubbers and Plastics" by R. H. Norman, published in 1970 by Elsevier Publishing Co. Ltd. and which is catalogued under U.S. Library of Congress Catalogue Card No. 78-122958.

It is an object of the present invention to provide new and improved electrically-conductive materials in which electrical resistivity is relatively low and is related to stress loading on the material.

According to the present invention there is provided an electrically-conductive material in which electrical resistivity is related to stress loading, which material comprises a homogeneous combination of a silicone rubber, graphitic carbon and a vegetable oil incorporating a plurality of fatty acids, the silicone rubber and vegetable oil together forming a unit volume of which the silicone rubber is present in the range 70–90% and the vegetable oil is present in the range 30–10%, the graphitic carbon being present in an amount of grammes weight in the range 50–90% of the milliliter content of said unit volume, the arrangement being such that the material has an electrical resistivity not exceeding 500 ohm-meters for stress loadings not exceeding 500 gm/mm$^2$, the magnitude of resistivity change for a stress change of 500 gm/mm$^2$ being at least one ohm-meter.

It will be appreciated that without departing from the scope of the invention the silicone rubber may be any one of a large number of known silicone rubbers such as are manufactured by ICI and Dow Corning and likewise the vegetable oil may be any one of a large number of known vegetable oils which incorporate a plurality of fatty acids. Selection of those constituents and of their relative amounts in relation to the relative amount of graphitic carbon determines the particular physical and electrical properties of the material. This selection is dependent upon the intended use of the material.

Embodiments of the present invention will now be described by way of example with reference to the accompanying tables and drawings, in which:

FIGS. 1–4 each illustrate the stress/strain characteristic for materials with different loadings of graphitic carbon and different vegetable oil content;

FIGS. 5–9 illustrate the electrical resistance/stress characteristic for selected ones of the materials referred to in FIGS. 1–4;

FIGS. 10–12 each illustrate the stress/strain characteristics for materials incorporating arachis oil subjected to repeated elongation (strain) cycling at three fixed cycling rates;

FIG. 16 is a table giving numerical values of selected parameters of some of the materials referred to in FIGS. 1–15;

FIG. 17 is a table listing the constituents of the various vegetable oils referred to in the materials whose characteristics are identified in FIGS. 1–15;

Figure 22:
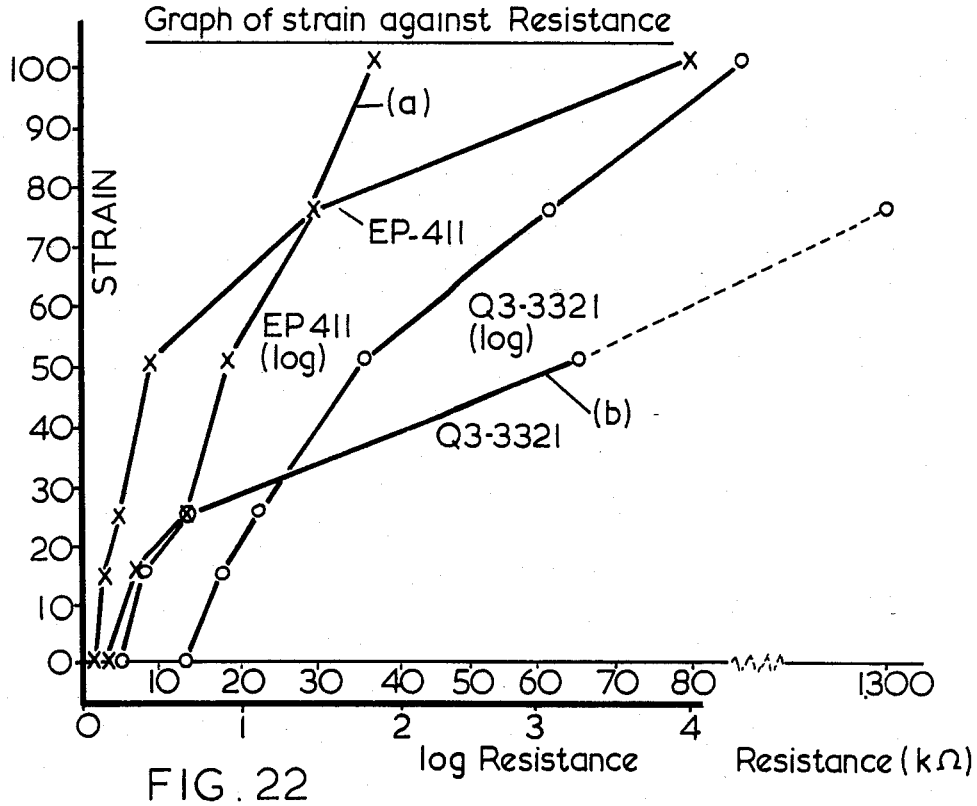
Figures 18, 19:
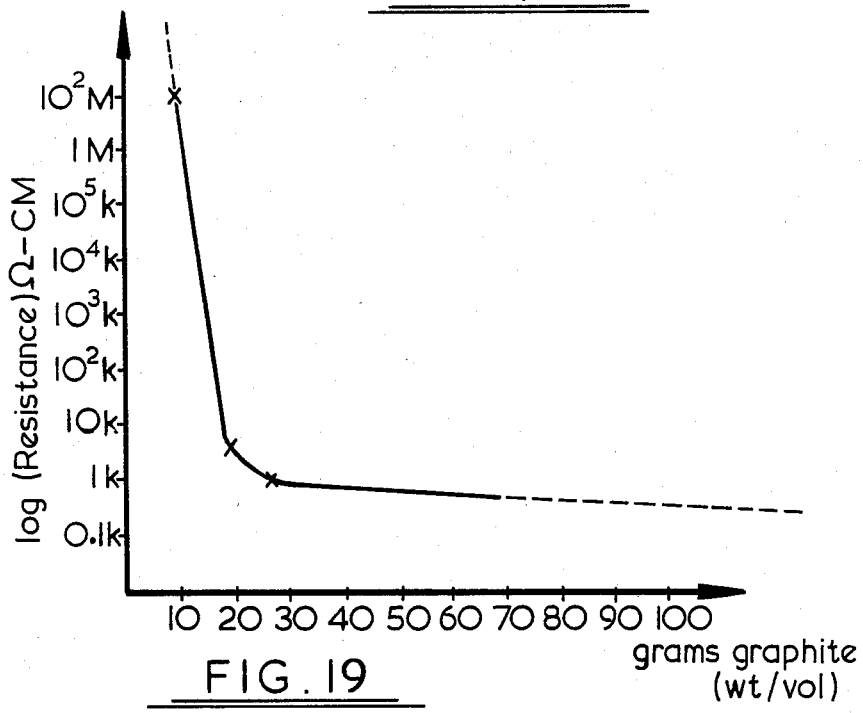
Figures 20, 21:
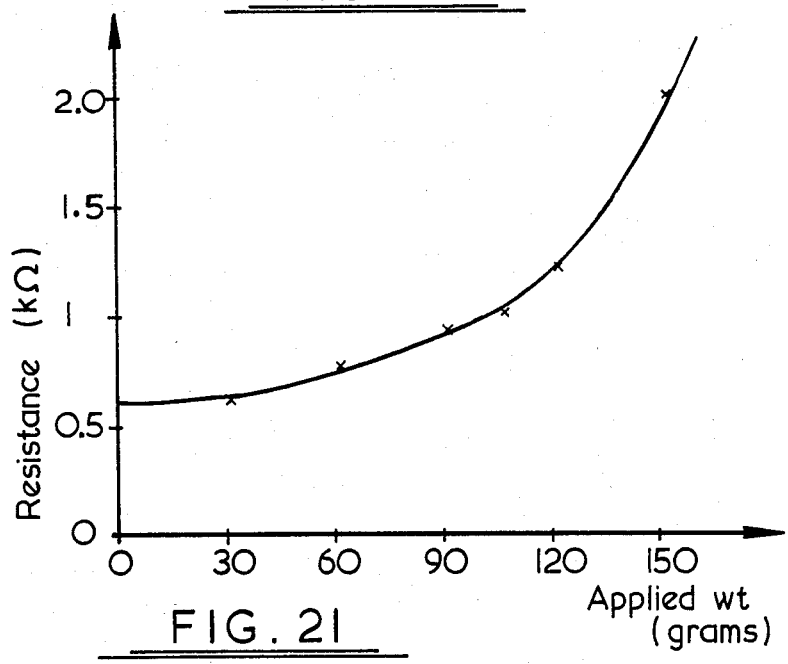

FIGS. 18 and 19 identify particular test results for a particular material;

FIGS. 20 and 21 identify particular test results for a different particular material; and FIG. 22 illustrates the strain/electrical resistance characteristics of two particular materials based on two different silicone rubbers.

In the description several examples of materials according to the present invention are described in composition and properties (both physical and electrical) and it is to be understood that each material was produced by intimately mixing the constituents in the proportions and quantities identified in a rotating shear mixer (such as a Kenwood Chef doughmixer) to obtain a homogeneous combination of the constituents. In all cases where the silicone rubber was composed of a silicone gum and a curing agent for that gum the material was cast into a sheet of 1 mm thickness and individual samples 150 mm by 10 mm cut therefrom for testing after a time delay of at least 16 hours during at least 5 hours of which the cut samples were held at a constant 23° C. at relative humidity 65%. The test procedure adopted was to grip each sample in jaws initially spaced 100 mm apart one jaw being held in a fixed location whilst the other jaw was moved to cause the sample to be elongated. In those tests where elongation to rupture was effected the movable jaw was moved at a constant rate of 10″/min. (inches per minute). In dynamic tests each sample was strained to 50% elongation a fixed number of times in immediate succession at each of three constant elongation rates, namely, 10″/min, 20″/min and 50″/min. In each case the loading applied to the movable jaw was noted in grammes to enable the stress on the sample cross-sectional area to be calculated in gm/mm$^2$.

Figure 2:
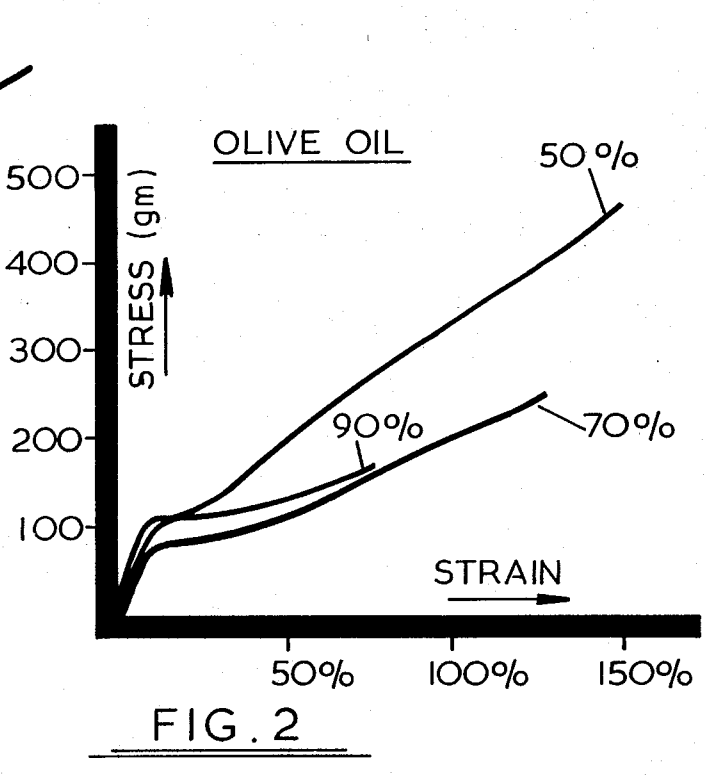
Figure 1:
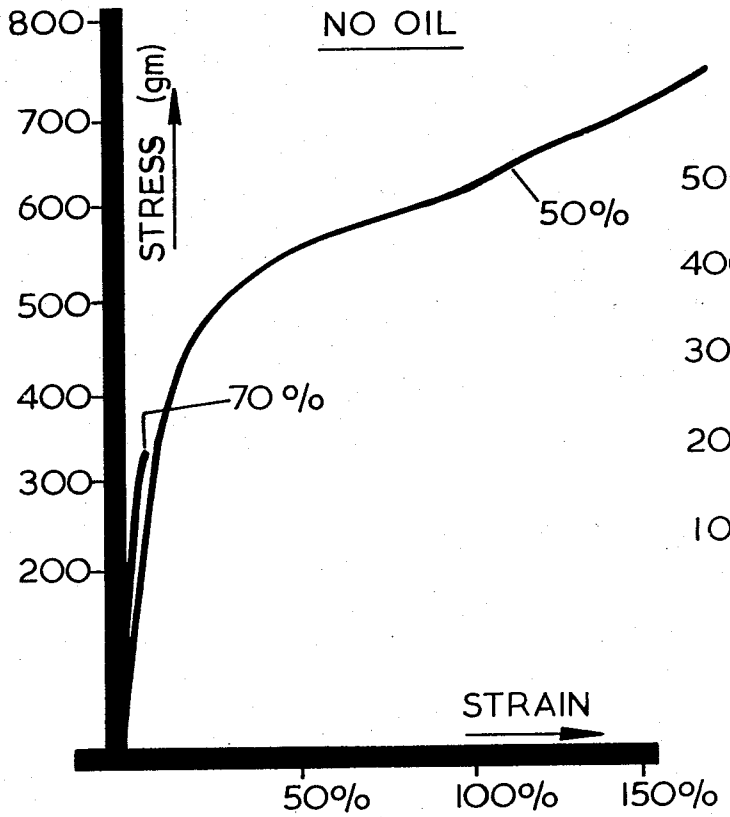
Figure 3:
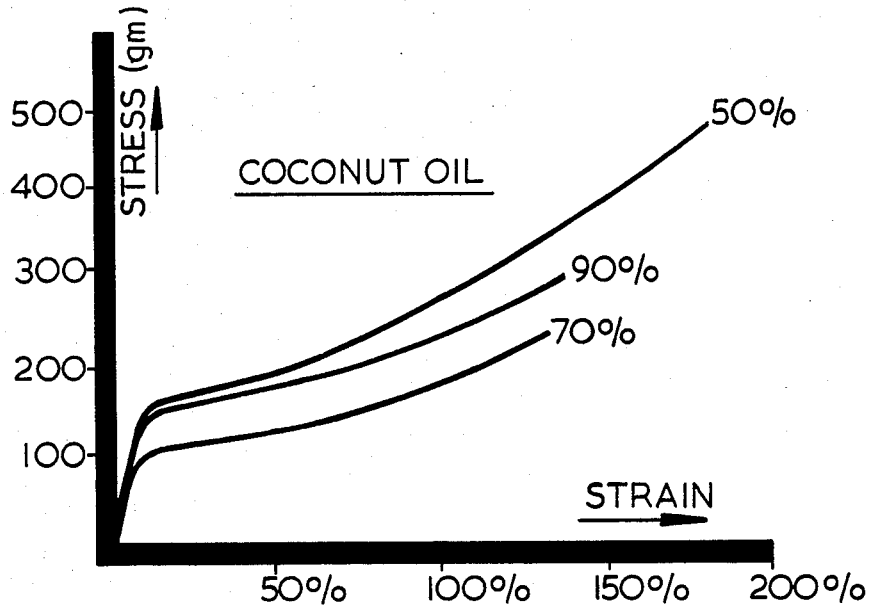
Figure 4:
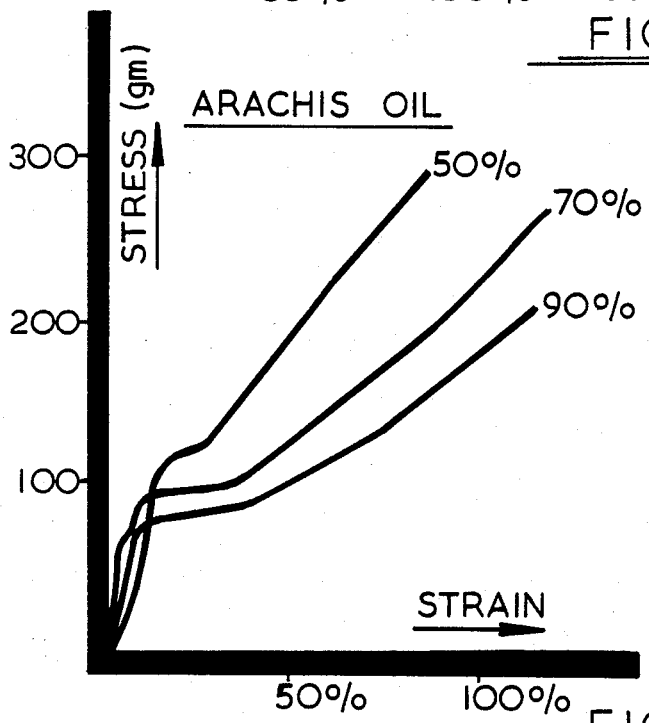

FIGS. 1–4 each illustrate the stress/strain characteristic for samples with different loadings of graphitic carbon. FIG. 1 illustrates samples containing no vegetable oil. FIG. 2 illustrates samples containing olive oil. FIG. 3 illustrates samples containing coconut oil and FIG. 4 illustrates samples containing arachis oil. In each of FIGS. 2, 3 and 4 the characteristics for graphitic loading at 50%, 70% and 90% are illustrated. It will be observed that these graphs illustrate improving physical properties from the zero oil arrangement of FIG. 1 through to the arachis oil arrangement of FIG. 4. The samples referred to in FIGS. 2–4 incorporated a constant 17% by volume of the pertaining oil but the particular silicone rubber ('C 2005' made by J-Sil Ltd, being room temperature vulcanising, and directly equivalent to Silcoset 105, that is ICI Ltd. EP 411 filled with calcium carbonate filler for strengthening purposes) and the particular size of the graphitic carbon ($\leqq 55$ μm) were the same in each case.

Figure 5:
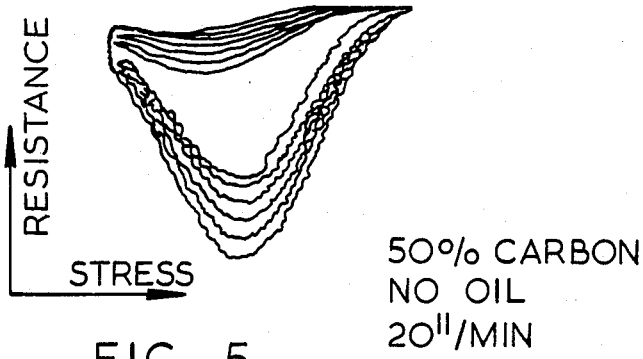

FIGS. 5–9 illustrate the electrical resistance/stress loading characteristic for certain of the samples referred to in FIGS. 1–4 when these samples are subjected to 5 cycles of extension to 50% strain, the rate at which elongation is effected being either 10 inches per minute or 20 inches per minute or 50 inches per minute. Thus FIG. 5 illustrates a sample with zero oil from which it will be seen that each cycle exhibits a substantial hysteresis effect, the nature of the hysteresis loop being different on each cycle. The degree of predictability therefore of the hysteresis effect is minimal. This sample contained 50% graphitic carbon. A similar test on a sample containing 70% graphitic carbon (and no oil) failed to produce any meaningful result because of very early rupture of the sample.

Figures 6, 7:
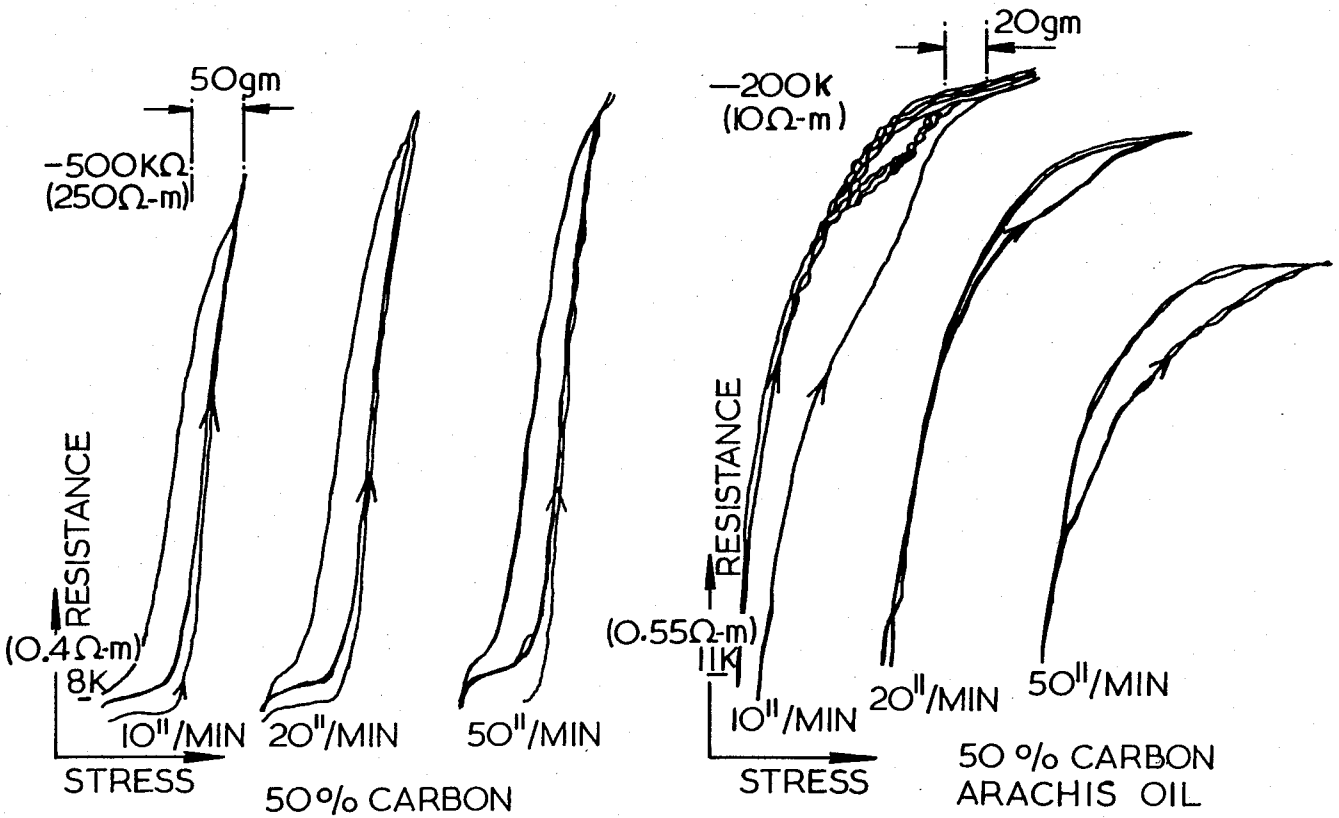

FIG. 6 illustrates a sample loaded with 50% graphitic carbon in the presence of coconut oil and subjected to cyclic elongation at 10, 20 and 50 inches per minute. It will be observed that in each case there is a hysteresis loop but the loop on each cycle remains substantially constant per cycle and from one elongation rate to another and is therefore predictable and the hysteresis effect is substantially less than that illustrated in FIG. 5.

FIG. 7 illustrates samples loaded with 50% graphitic carbon in the presence of arachis oil and respectively subjected to 10, 20 and 50 inches per minute stretch. It will be observed that at the lowest stretch rate although there is a hysteresis loop it is extremely small and of negligible effect. At the intermediate stretch rate of 20 inches per minute the hysteresis loop is again nearly negligible and in each cycle is constant. At the stretch rate of 50 inches per minute the hysteresis loop is somewhat more significant but is noticeably less than that for coconut oil and is predictable in that it is constant from cycle to cycle.

Figure 8:
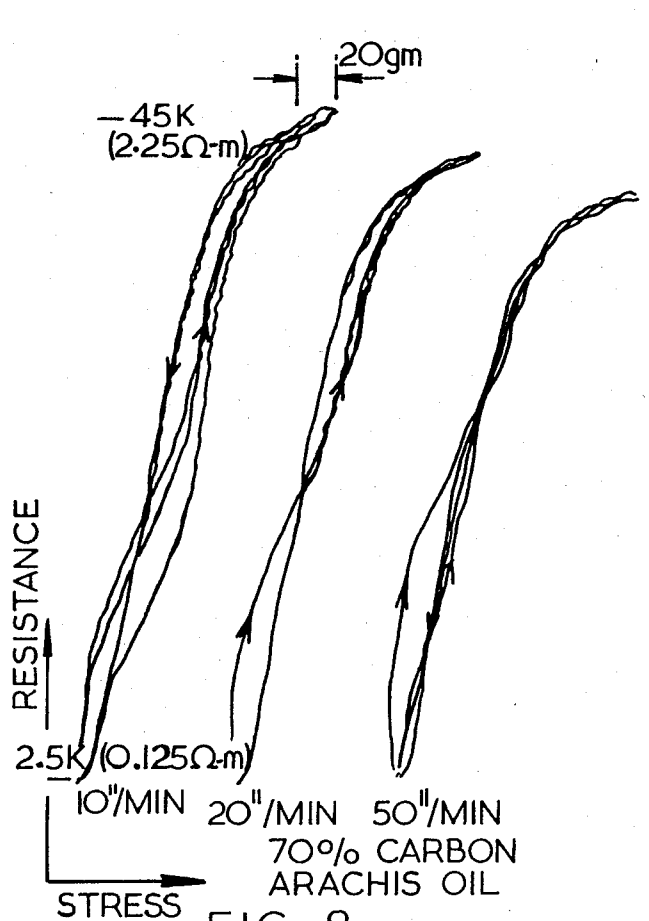

FIG. 8 illustrates samples loaded with 70% graphitic carbon in the presence of arachis oil and at stretch rates of 10, 20 and 50 inches per minute. It will be observed that in each case the hysteresis loop is of extremely small extent substantially the same from one stretch rate to another and is predictable in that it remains constant from cycle to cycle.

Figure 9:
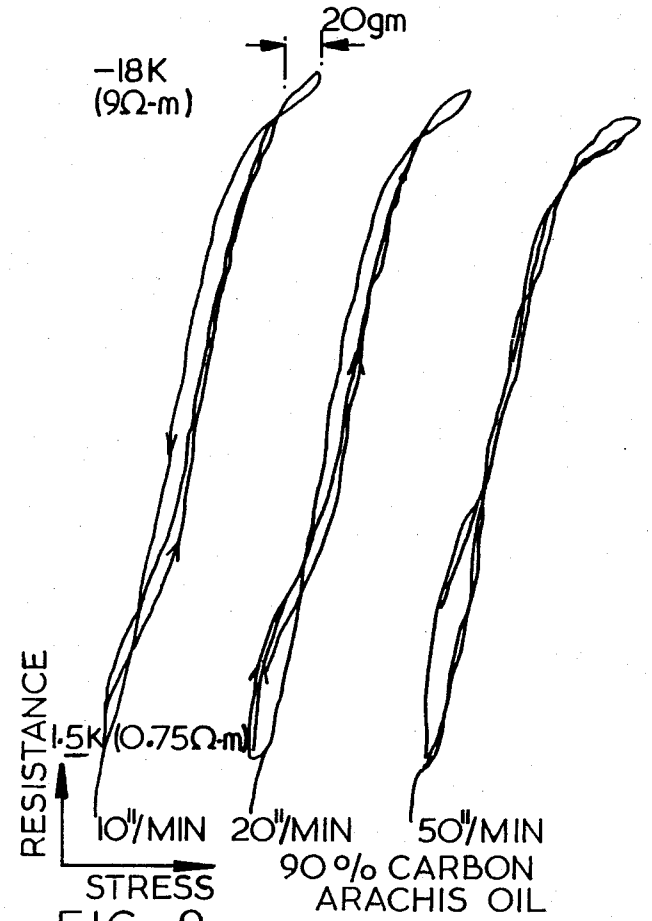

FIG. 9 illustrates samples loaded with 90% graphitic carbon in the presence of arachis oil and stretched at 10, 20 and 50 inches per minute. It will be observed that in each instance the extent of the hysteresis loop is of extremely small extent and is predictable in that it remains constant from cycle to cycle and from one stretch rate to another.

It will be appreciated that each of FIGS. 6–9 is in fact a composite of three graphs which are aligned in the interests of comparability and numeric values of resistance and stress are identified. It will be noted that the resistance change is very considerable in each instance. Coconut oil produces a resistance change from about 10KΩ up to several hundred KΩ whereas arachis oil has a much lower initial resistance of the order of one or two KΩ and its change is up to about 40KΩ.

Figure 10:
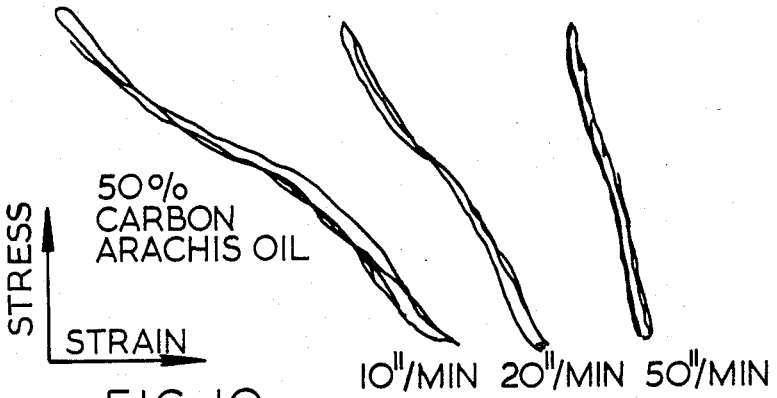
Figure 11:
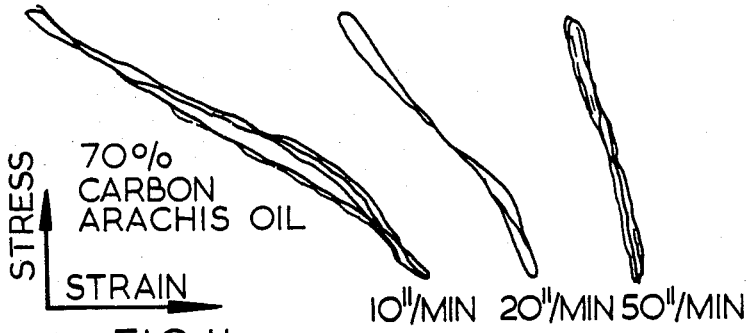
Figure 12:
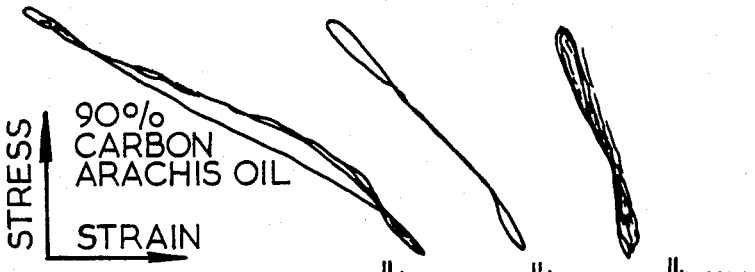

FIGS. 10–12 each illustrate samples loaded with graphitic carbon in the presence of arachis oil and subjected to repeated cycling of elongation to 50% strain at rates of 10, 20 and 50 inches per minute to illustrate the stress/strain characteristic. It will be observed from FIG. 10 that at 50% graphitic carbon there is a negligibly small hysteresis effect in the physical properties of the sample no matter the rate of extension. FIG. 11 illustrates substantially the same performance from samples loaded with 70% graphitic carbon in the presence of arachis oil and FIG. 12 again illustrates substantially the same effect with samples loaded with 90% graphitic carbon in the presence of arachis oil.

Figure 13:
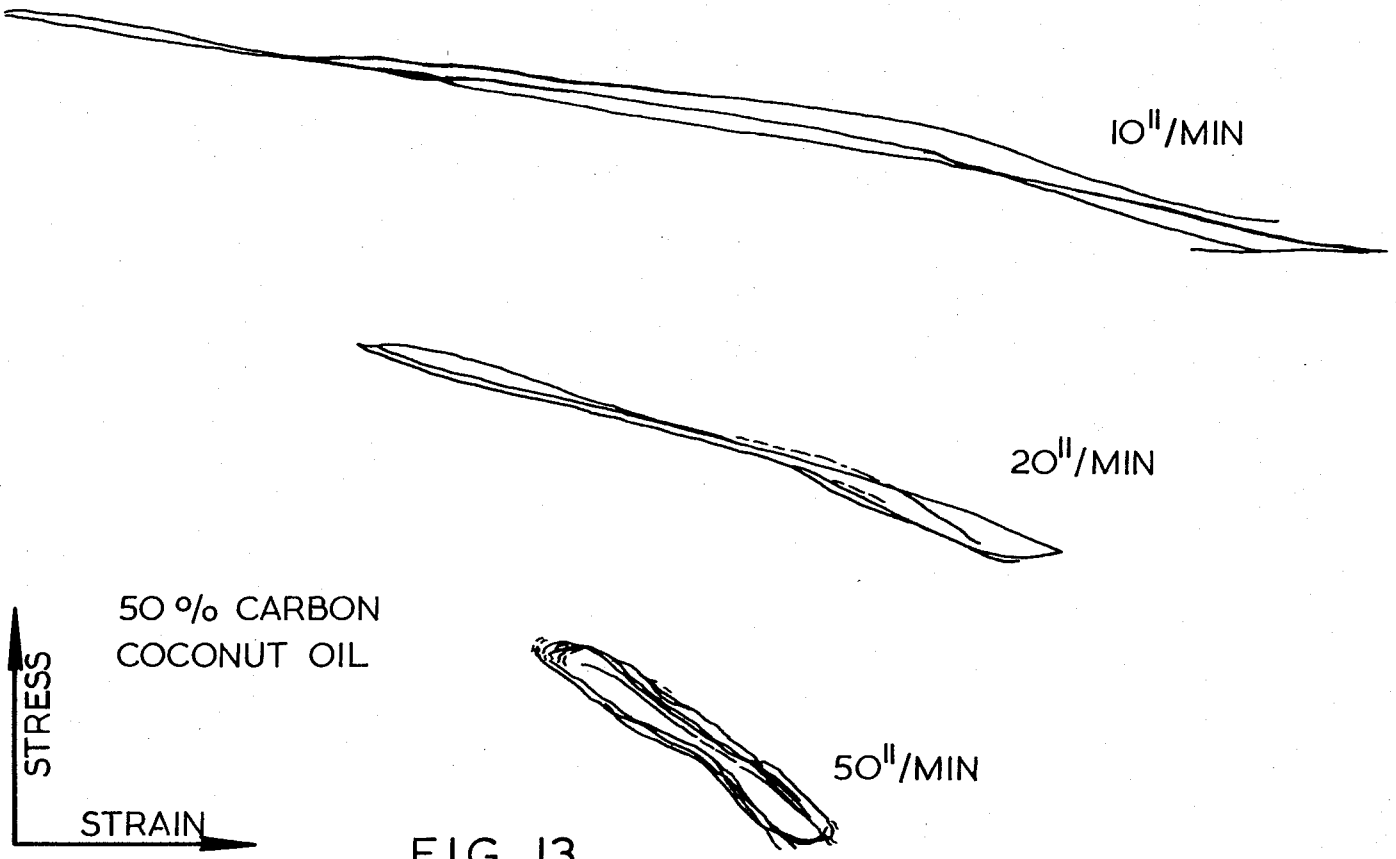
FIGS. 13–15 illustrate stress/strain characteristics corresponding to those of FIGS. 10–12 but for materials incorporating coconut oil.
Figure 14:
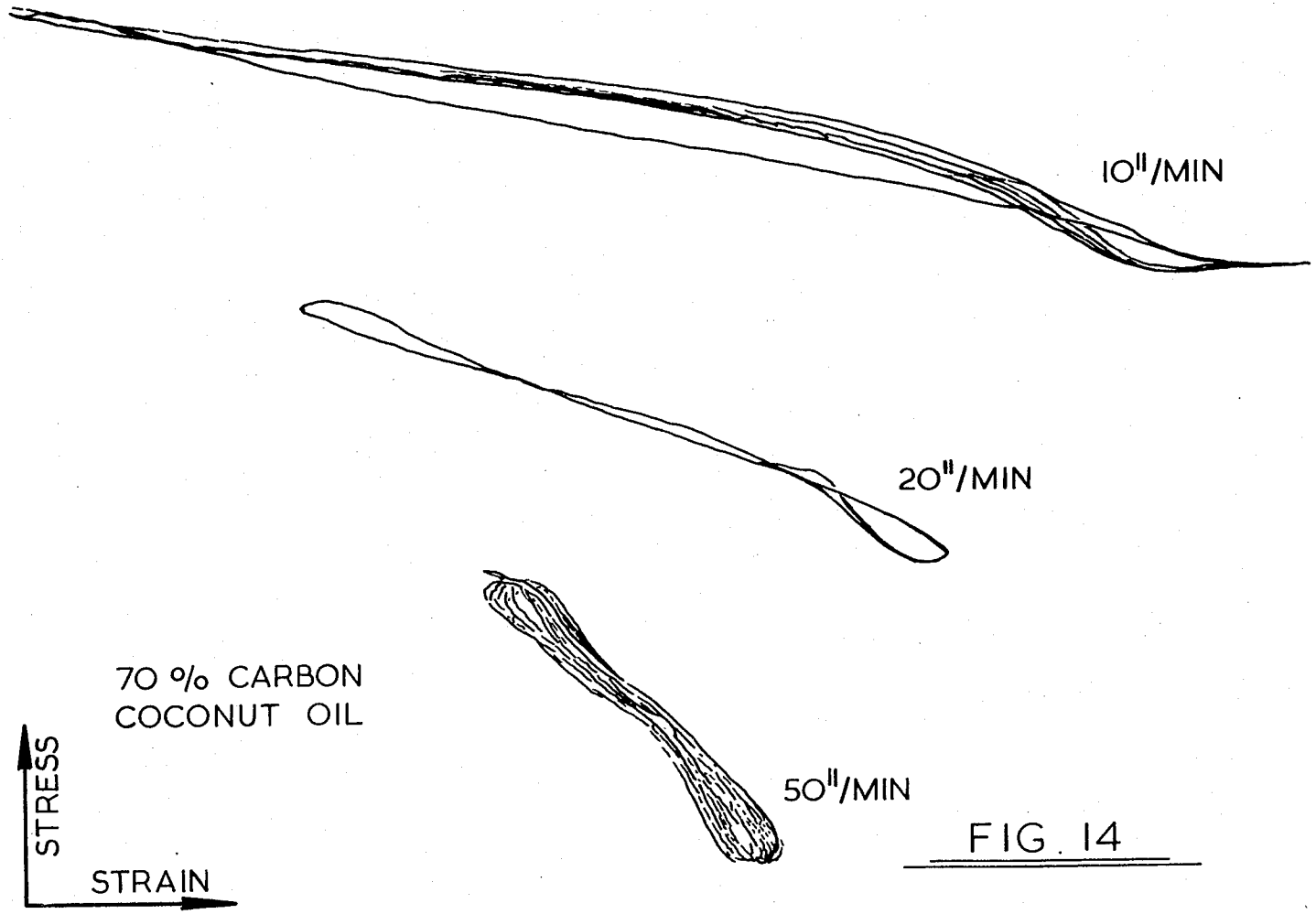
Figure 15:
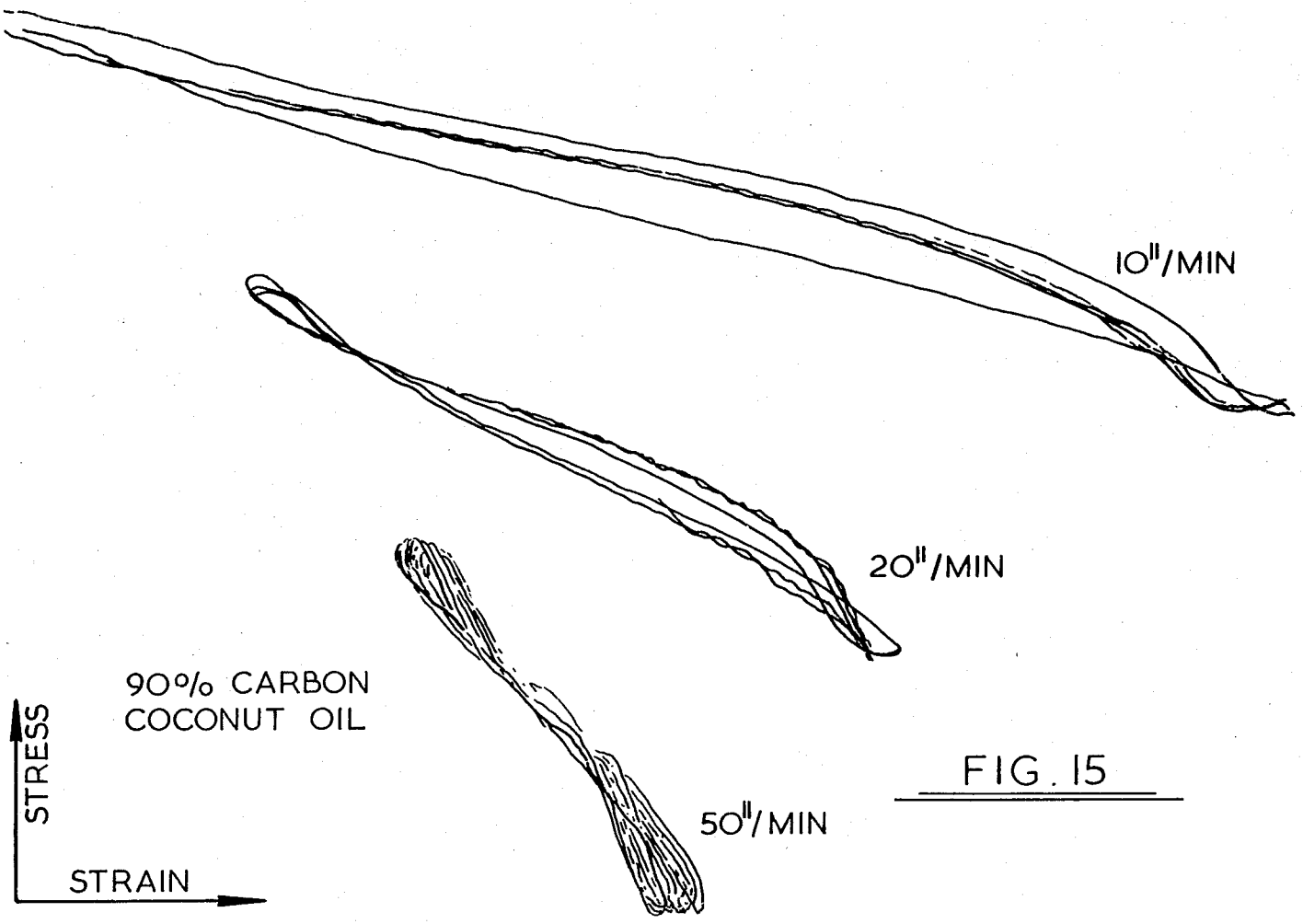

FIGS. 13–15 each illustrate samples loaded with graphitic carbon in the presence of coconut oil and subjected to repeated cycling of elongation to 50% strain at rates of 10, 20 and 50 inches per minute to illustrate the stress/strain characteristic. It will be observed from FIG. 13 that at 50% graphitic carbon there is a very small hysteresis effect in the physical properties of the sample no matter the rate of extension. FIG. 14 illustrates substantially the same performance from samples loaded with 70% graphitic carbon in the presence of coconut oil and FIG. 15 again illustrates substantially the same effect with samples loaded with 90% graphitic carbon in the presence of coconut oil. It will be noted from a comparison of FIGS. 10–12 and FIGS. 13–15 that the extent of hysteresis in the physical properties of the samples containing arachis oil is noticeably better than the samples containing coconut oil, but in each case the hysteresis effect is substantially less than that exhibited by samples containing no oil.

FIG. 16 is a comparative table illustrating the respective numerical values of various parameters of the samples whose characteristics are referred to in FIGS. 1–15.

The various vegetable oils which have been referred to in FIGS. 1–16, namely, olive oil, coconut oil, palm oil and arachis oil are each representative of fixed vegetable oils, the term "fixed" referring to the absence of volatile constituents in the oils. Substantially all vegetable oils contain oleic acid and linoleic acid, both of which are unsaturated fatty acids and it is believed that it is the combination of these two unsaturated fatty acid constituents in the vegetable oils which permits the physical and electrical properties which have been illustrated to be achieved. In particular it is thought that the oleic acid constituent functions as a plasticiser during manufacture of the samples whilst the linoleic acid constituent functions as a dispersant for the graphitic particles. It is believed that these acidic constituents in combination cause a physical breakdown of the graphitic carbon particles to a near molecular size depending upon the duration of mixing of the constituents in the material by means of the rotating shear mixer. This theory has been supported by electron microscopy testing on a number of samples, but testing has not been conducted on all samples. It is however to be noted that the comparative quantity of these unsaturated fatty acids in the oil has a bearing on the nature of the properties achieved by the material because arachis oil produces substantially better results than does olive oil. At the same time the effect of saturated fatty acid constituents is not negligible as is demonstrated by the good properties achieved by samples containing coconut oil. FIG. 17 tabulates the fatty acid constituents of the various vegetable oils previously referred to.

We now provide a listing of several specific examples of materials in accordance with the present invention:

EXAMPLE 1

A piezoresistive composition mixture having 10 ml (82.64%) silicone polymer gum (EP411-ICI); (0.83%) curing agent A for the polymer; 2 ml (16.53%) of arachis oil was admixed and 1 gram (8.3%) of graphite powder 300 or greater mesh size (≦53 μm according to British Standard 410), was added to the mixture and mixing was performed by a rotating shear mixer. The resultant elastomeric material was cast and left to set. Samples of the material were then tested so that the change in electrical resistance for applied load (grammes) in 50 gramme steps was recorded, up to 250 grammes. The resistance recorded was never below 20MΩ. Corresponding tests were performed on samples with graphite in amounts of 2, 3, 4 and 8 grammes respectively. The samples were also strained to rupture and their flexibility assessed by counting the number of successive 180° bends or flexes before failure by breaking.

The results of these tests are tabulated in FIGS. 18 and 19. It is evident that for increasing amounts of graphite powder the electrical resistance of the sample decreases; the rupture strain also decreases but the flexibility of the sample greatly increases. For graphite content greater than about 15% the static electrical resistance is in the KΩ range and remained in the KΩ range throughout the stress loading.

In addition, when stress loaded by a fixed amount the resistance value changed initially then decreased by a small amount, but when loads were first repeatedly applied then removed, i.e. cycled loading and unloading, there was thereafter no variation in resistance for a static load. It is considered that the observed resistance creep response can therefore be overcome by sample preconditioning (i.e. repeated load cycling).

The samples with 8 g of graphite powder was subjected to further testing. The change in resistance for change in applied strain was noted and the results identified in FIG. 22. Two samples were tested (1–2 mm thick) and the results averaged. Curve (a) of FIG. 22 shows that the resistance is in the KΩ range and that the change in resistance is also in the KΩ over at least 75% strain. It is to be noted that the graph is substantially linear.

EXAMPLE 2

A composition similar to Example 1 was prepared with Dow Corning Silicone elastomer (Q3-3321) used instead of EP411 and with 8 gm graphite powder. The sample dimensions and tests performed were repeated and the results identified in FIGS. 20 and 21 and on curve (b) of FIG. 22.

In this example the static resistance is in the KΩ range and the resistance increases considerably, into the MΩ, range over a change in strain of about 75%.

EXAMPLE 3

A composition of the same composition as example 1 and having 8 gm graphite powder was prepared and non-oriented carbon fibre (1.5 g) was added to the mixture prior to the addition of the curing agent. The resultant elastomeric material was cut into samples which were tested and the results averaged. Each sample was 1 mm thick. The static resistance was in KΩ range and a total load of 200 grammes was applied in 50 gramme steps. The change in resistances measured was in the KΩ range (1.3KΩ–70KΩ). The average rupture strain was 233% and more than 400 180° flexes of the samples were performed before failure. The static resistance was 0.65KΩ.

EXAMPLE 4

A composition comprising 100 ml RS (Radio spares) silicone rubber gum, 20 ml arachis oil, and 80 grammes graphite powder was prepared; no curing agent was added because this particular rubber gum cures in air and the mixture was left to cure (24–48 hours) during which time acetic acid was given off. Three samples were tested and the results averaged. The static resistance was in the KΩ range (8.3KΩ; 4.15 ohm-meters.) A total stress load of 200 grammes was applied in 50 gramme steps. The change in resistance was measured in the KΩ range up to 100 grammes and thereafter the resistance exceeded 20MΩ. The average rupture strain was 550% and more than 400 180° flexes of the samples were performed before failure. This composition is suitable for use as a piezoelectric resistance up to applied loads of about 100 grammes.

In the various samples tested and examples given the silicone rubber (and it is to be noted that this is in distinction to isoprene rubber, neoprene rubber and latex rubber) has been either a Dow Corning composition or an ICI composition or a Radio Spares composition in each case accompanied by the appropriate curing agent as recommended by the manufacturer. However other forms of silicone rubber may be used and if there is no requirement to cure the rubber gum for the purpose of achieving elastomeric properties the gum may be left uncured. It is envisaged that uncured silicone rubber would be encased in an appropriate membrane and be electro-responsive to stress loading in the absence of strain loading. Likewise the carbon content of the material is graphitic carbon in distinction to other forms of carbon. Graphitic carbon is known to exist as sets of platelets organised in a generally linear format as distinct from a ball-like format which is found, for example, in acetylene black (which is one other form of carbon).

Silicone rubbers exist in two forms one being vulcanised at elevated temperatures and the other form at room temperature in each case cross-linking of the silicone chains taking place. The silicone rubbers which we prefer to use are vulcanised at room temperature conveniently by a condensation reaction using di-butyltin di-laurate (DBTL) since this enables curing to take place without boiling off any of the vegetable oil. By way of example arachis oil boils at 95° C.

We have also discovered that the amount of vegetable oil in the material can be varied quite considerably but in concentrations less than about 10% of the unit volume previously referred to there is a marked tendency for an uneven distribution of the constituents of the material which results in relatively poor physical properties similar to that exhibited in the absence of vegetable oil. At concentrations greater than about 30% of the unit volume there is a marked tendency for excess oil to accumulate on the surface of the material in the form of droplets which is physically undesirable and if the concentration is substantially greater than 30% of the unit volume this tends to prevent or at least greatly delay cure of the material. Within the range 10% to 30% of vegetable oil we have found the material to have qualities which are acceptable for a variety of uses in having a low resistance value which is variable according to the stress loading on the material. When the vegetable oil is selected to be arachis oil we have achieved optimal characteristics for an oil concentration of about 20% of the unit volume.

It will be appreciated that the resistivity figures quoted are evaluated from the measured electrical resistance and the known dimensions of the sample.

What is claimed is:

1. An electrically-conductive material in which electrical resistivity is related to stress loading, which material comprises a homogeneous combination of a silicone rubber, graphitic carbon and a vegetable oil, the silicone rubber and vegetable oil together forming a unit volume of which the silicone rubber is present in the range 70–90% and the vegetable oil is present in the range 30–10%, the graphitic carbon being in particulate form and present in an amount of of grammes weight in the range 50–90% of the milliliter content of said unit volume, the arrangement being such that the material has an electrical resistivity not exceeding 500 ohm-meters for stress loadings not exceeding 500 gm/mm$^2$ the magnitude of resistivity change for a stress change of 500 gm/mm$^2$ being at least one ohm-meter.

2. A material as claimed in claim 1, wherein said silicone rubber comprises a silicone gum and a curing agent for said gum, said gum and curing agent being present in proportions by volume of 100 to 1 respectively.

3. A material as claimed in claim 2, wherein for stress loadings not exceeding 500 gm/mm$^2$ the stress/strain relationship is elastic.

4. A material as claimed in claim 1, wherein said silicone rubber comprises a silicone gum loaded with an inert filler.

5. A material as claimed in claim 1, wherein said vegetable oil is selected from the group of vegetable oils consisting of olive oil, coconut oil, palm oil and arachis oil.

6. A material as claimed in claim 1, wherein said graphitic carbon is in the form of particles having a size not exceeding 55 $\mu$m.

7. An electrically-conductive material in which electrical resistivity is related to stress loading, which material comprises a homogeneous combination of a silicone rubber, graphitic carbon and a vegetable oil, the silicone rubber and vegetable oil together forming a unit volume of which the silicone rubber is present in the range 70–90% and the vegetable oil is present in the range 30–10%, the graphitic carbon being in micron-sized particulate form present in an amount of grammes weight in the range 50–90% of the milliliter content of said unit volume, and wherein said vegetable oil includes at least one unsaturated fatty acid having a carbon chain length of not less than 16.

8. A material as claimed in claim 7, wherein said at least one unsaturated fatty acid has a carbon chain length of 18.

9. A material as claimed in claim 7, wherein said vegetable oil is selected from the group of vegetable oils consisting of olive oil, coconut oil, palm oil and arachis oil.

* * * * *